US008177222B2

(12) United States Patent
Yaginuma

(10) Patent No.: US 8,177,222 B2
(45) Date of Patent: May 15, 2012

(54) SHEET FEEDING APPARATUS AND IMAGE FORMING APPARATUS

(75) Inventor: Masatoshi Yaginuma, Toride (JP)

(73) Assignee: Canon Kabushiki Kaisha (JP)

( * ) Notice: Subject to any disclaimer, the term of this patent is extended or adjusted under 35 U.S.C. 154(b) by 164 days.

(21) Appl. No.: 12/198,884

(22) Filed: Aug. 26, 2008

(65) Prior Publication Data

US 2009/0057986 A1 Mar. 5, 2009

(30) Foreign Application Priority Data

Aug. 28, 2007 (JP) ..... 2007-220834

(51) Int. Cl.
*B65H 3/14* (2006.01)
*B65H 1/18* (2006.01)

(52) U.S. Cl. ..... 271/152; 271/98

(58) Field of Classification Search ..... 271/152, 271/162, 157, 154, 155, 97, 98
See application file for complete search history.

(56) References Cited

U.S. PATENT DOCUMENTS

| | | | | |
|---|---|---|---|---|
| 5,335,903 | A * | 8/1994 | Martin et al. | 271/157 |
| 6,279,896 | B1 * | 8/2001 | Linder et al. | 271/98 |
| 6,332,609 | B1 * | 12/2001 | Arakawa | 271/157 |
| 7,681,879 | B2 * | 3/2010 | Fuchi | 271/162 |
| 2003/0015836 | A1 * | 1/2003 | Westcott et al. | 271/152 |
| 2004/0061280 | A1 * | 4/2004 | Sciurba et al. | 271/152 |
| 2005/0156370 | A1 * | 7/2005 | Lang et al. | 271/9.1 |
| 2005/0206068 | A1 | 9/2005 | Sasaki et al. | |
| 2006/0232001 | A1 * | 10/2006 | Otaki | 271/157 |
| 2007/0052155 | A1 * | 3/2007 | Cook et al. | 271/152 |
| 2007/0096387 | A1 * | 5/2007 | Sciurba et al. | 271/152 |
| 2007/0228639 | A1 * | 10/2007 | Matsumoto et al. | 271/97 |
| 2009/0295071 | A1 * | 12/2009 | Takahashi et al. | 271/162 |

FOREIGN PATENT DOCUMENTS

| | | | |
|---|---|---|---|
| JP | 7-196187 | A | 8/1995 |
| JP | 10-316262 | A | 12/1998 |
| JP | 11-208930 | A | 8/1999 |
| JP | 2005-272019 | A | 10/2005 |

OTHER PUBLICATIONS

Office Action issued Dec. 27, 2011 for corresponding JP2007-220834 (Partial English translation provided).

* cited by examiner

*Primary Examiner* — Kaitlin Joerger
*Assistant Examiner* — Patrick Cicchino
(74) *Attorney, Agent, or Firm* — Rossi, Kimms & McDowell LLP

(57) ABSTRACT

A sheet feeding apparatus which feeds each of sheets lifted by blowing air, wherein the amount of movement of a tray from the detection of the tray which stacks a plurality of sheets by a lower position detecting sensor to the detection of the uppermost position of the sheets on the tray by a sheet surface detecting sensor is m, wherein the amount of movement of the tray until the sheet on the tray is positioned within a predetermined range when the sheet on the tray is outside from between the lifting lower limit sensor and the lifting upper limit sensor (the predetermined range) is q, wherein the amount of the sheets stacked on the tray is calculated from the amount of movement m+q of the tray and is then displayed on a remaining amount displaying portion.

8 Claims, 13 Drawing Sheets

*FIG. 10*

| | DISTANCE [mm] | COUNT VALUE [dec] | REGISTER VALUE [hex] |
|---|---|---|---|
| UPPER LIMIT POSITION | 123 | 400 | 8199 |
| LIFTING UPPER LIMIT POSITION | 120 | 391 | 8187 |
| LIFTING LOWER LIMIT POSITION | 117 | 381 | 817D |
| SHEET SURFACE POSITION | 111 | 361 | 8169 |
| ACC POSITION | 107 | 349 | 815D |
| TRAY LOWER POSITION | 0 | 0 | 8000 |
| LOWER LIMIT POSITION | −4 | −13 | 7FF3 |

SHEET FEEDING APPARATUS AND IMAGE FORMING APPARATUS

BACKGROUND OF THE INVENTION

1. Field of the Invention

The present invention relates to a sheet feeding apparatus which feeds each of stacked sheets and an image forming apparatus which has the sheet feeding apparatus.

2. Description of the Related Art

To transfer a toner image formed on a photosensitive member onto sheets in a transfer position, an image forming apparatus, such as a copying machine or a printer, has a sheet feeding apparatus which feeds each of the sheets cut in a predetermined size to the transfer position.

There has been disclosed a sheet feeding apparatus which blows air to one-end side of sheets stacked on a tray of a storage case in a conveying direction by a loosening fan so as to lift the sheets and then adsorbs the lifted sheets onto an adsorbing and conveying belt to convey them (see Japanese Patent Application Laid-Open No. 7-196187).

The amount of lifting of the sheets is different depending on their material (thickness or weight). There has been proposed a sheet feeding apparatus which controls the raising or lowering of a tray which stacks the sheets so as to position the lifting position of the uppermost sheet lifted by blowing air within a predetermined range. Whether the lifting position of the uppermost one of the lifted sheets is within the predetermined range or not is judged by a position detecting portion. When it is outside the predetermined range, the tray is raised or lowered and is then controlled such that the uppermost sheet is positioned within the predetermined range (see Japanese Patent Application Laid-Open No. 2005-272019).

There has been known control in which one of the sheet feeding start timing of the sheet feeding apparatus and the toner image forming start timing of the image forming apparatus body precedes the other. Here, the control in which the feeding start timing precedes the image forming start timing is called image forming precedence control. The control in which the image forming start timing precedes the feeding start timing is called sheet feeding precedence control.

In an image forming apparatus which performs the image forming precedence control, the image forming operation of the image forming apparatus body is enabled until there are no sheets in the sheet feeding apparatus and need not detect the remaining amount of sheets during the feeding operation. Image forming is not started at the detection of the absence of sheets. The image forming apparatus can be easily stopped.

In an image forming apparatus which performs the sheet feeding precedence control, when there are no sheets in the sheet feeding apparatus to stop the image forming apparatus, image forming has already been started in the image forming apparatus body. The recovery process of the photosensitive member (cleaning of the photosensitive member) during image forming is necessary. To avoid the recovery process, there has been proposed an image forming apparatus which arranges a sensor which detects the remaining amount of sheets in the sheet feeding apparatus and, when the remaining amount of sheets is reduced and the sensor is turned on, changes from the image forming precedence control to the sheet feeding precedence control (see U.S. Pat. No. 6,567,620).

In the sheet feeding apparatus which blows air to lift sheets, the timing at which the sensor which detects the remaining amount of sheets is turned on is changed depending on the lifted state of the sheets, thereby increasing an error of the remaining amount of sheets in the sheet feeding apparatus.

SUMMARY OF THE INVENTION

The present invention provides a sheet feeding apparatus which feeds each of sheets lifted by blowing air and can stably detect the remaining amount of the sheets in the sheet feeding apparatus regardless of the lifted state of the sheets.

To achieve the above object, the present invention provides a sheet feeding apparatus including a tray which stacks a plurality of sheets and is raised or lowered; an air blowing portion which blows air toward the ends of the sheets stacked on the tray to loosen the sheets; a conveying portion which conveys the uppermost one of the sheets loosened by the air from the air blowing portion; a sheet detecting portion which detects whether the uppermost one of the sheets loosened by the air from the air blowing portion is positioned within a predetermined range; a sheet surface detecting portion which detects the uppermost position of the sheets stacked on the tray; a tray detecting portion which detects a reference position of the tray below the sheet surface detecting portion in a sheet stacking direction; a tray movement detecting portion which detects the amount of movement of the tray; and a remaining amount displaying portion which displays the amount of the sheets stacked on the tray calculated from a detected result of the tray movement detecting portion; wherein the amount of movement of the tray from the detection of the tray by the tray detecting portion to the detection of the uppermost position of the sheets on the tray by the sheet surface detecting portion is m, wherein the amount of movement of the tray until the sheet on the tray is positioned within the predetermined range when the sheet on the tray is outside the predetermined range is q, wherein the amount of the sheets stacked on the tray is calculated from the amount of movement m+q of the tray and is then displayed on the remaining amount displaying portion.

According to the present invention, the amount of the sheets stacked on the tray is calculated from the amount of movement m+q of the tray. The remaining amount of the sheets in the sheet feeding apparatus can be stably detected regardless of the lifted state of the sheets.

Further features of the present invention will become apparent from the following description of exemplary embodiments with reference to the attached drawings.

BRIEF DESCRIPTION OF THE DRAWINGS

FIG. 10 is a table describing the relation between the count numbers of an encoder, the distances between a reference position and a tray, and the set values of a register in a RAM of the controlling portion;

DESCRIPTION OF THE EMBODIMENTS

Exemplary embodiments of the present invention will be illustratively described below in detail with reference to the drawings. The dimensions, materials, shapes, and relative arrangement of components described in the following embodiments should be appropriately changed by the configuration and various conditions of an apparatus to which the present invention is applied. Unless otherwise specified, the scope of the present invention is not limited to them only.

(Description of an Image Forming Apparatus)

Figure 1:
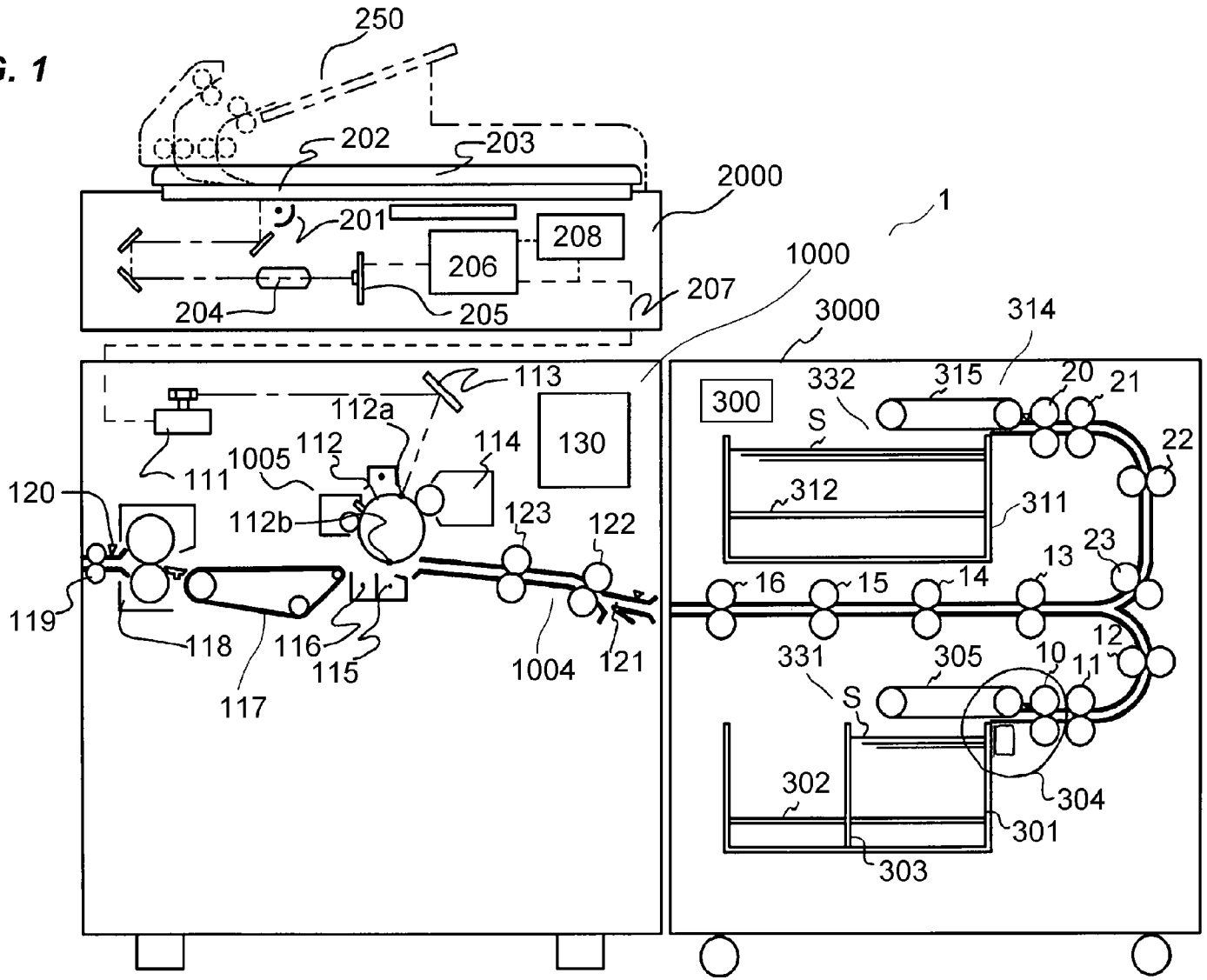
FIG. 1 is a schematic sectional view illustrating the configuration of an image forming apparatus which arranges a sheet feeding apparatus of this embodiment therein.

The schematic configuration of an image forming apparatus illustrated in FIG. 1 will be described. FIG. 1 is a schematic sectional view illustrating the schematic configuration of the image forming apparatus having a sheet feeding apparatus.

In FIG. 1, an image forming apparatus 1 has a printer body 1000, and a scanner 2000 arranged on the top surface of the printer body 1000. The image forming apparatus 1 has a sheet feeding apparatus 3000 which feeds a sheet to the printer body 1000. The sheet feeding apparatus 3000 has an air separating and feeding mechanism as a sheet separating and feeding portion to stably separate and feed many types of sheets. The sheet feeding apparatus 3000 will be described later in detail.

The image forming apparatus 1 will be described in detail. The scanner 2000 which reads an original has a scanning optical system light source 201, a platen glass 202, an original pressing plate 203 which is opened or closed, a lens 204, a light receiving device (photoelectric conversion) 205, an image processing portion 206, and a memory portion 208. The memory portion 208 stores an image processing signal processed by the image processing portion 206.

The original placed on the platen glass 202 is read by being illuminated with a light by the scanning optical system light source 201. The read original image is processed by the image processing portion 206, and is then converted to an electrically encoded electric signal 207 so as to be transmitted to a laser scanner 111 as an image forming portion. The image information processed and encoded by the image processing portion 206 can also be stored once in the memory portion 208 and transmitted to the laser scanner 111 by a signal from a controlling portion 130, as needed.

The printer body 1000 has a sheet conveying portion 1004 which conveys the sheet fed by the sheet feeding apparatus 3000 to an image forming portion 1005, and the controlling portion 130 which controls the printer body 1000.

The sheet conveying portion 1004 has a registration roller portion which has a pair of rollers before registration 122 and a pair of registration rollers 123. The sheet fed from the sheet feeding apparatus 3000 is guided by a sheet conveying path 121 configured by a guide plate and then passes through the pair of rollers before registration 122 so as to be led to the pair of registration rollers 123. The sheet is abutted on the pair of registration rollers 123. The sheet with skew feeding caused at the feeding and conveying of the sheet is corrected is conveyed to the image forming portion 1005.

The image forming portion 1005 has a photosensitive drum 112, the laser scanner 111, a development device 114, a transfer charger 115, and a separating charger 116. In image forming, a laser beam from the laser scanner 111 is folded over by a mirror 113 and then illuminates an exposure position 112*a* on the photosensitive drum 112 rotated clockwise in FIG. 1. A latent image is formed on the photosensitive drum 112. The latent image formed on the photosensitive drum 112 appears as a toner image by the development device 114. The illuminating position of the laser beam can be changed by a control signal from the controlling portion 130 via a laser writing position control circuit. The latent image forming position in a longitudinal direction of the photosensitive drum 112 or in a so-called main scanning direction can be changed.

The toner image on the photosensitive drum 112 is transferred onto the sheet by the transfer charger 115 in a transfer portion 112*b*. The sheet onto which the toner image is transferred is electrostatically separated from the photosensitive drum 112 by the separating charger 116 and is then conveyed to a fixing device 118 by a conveying belt 117 so as to be subjected to fixing of the toner image. The sheet onto which the toner image is fixed is discharged to the outside of the image forming apparatus by a discharge roller 119. A discharge sensor 120 is provided in the conveying path between the fixing device 118 and the discharge roller 119 and can detect the passage of the sheet there.

In this embodiment, the printer body 1000 and the scanner 2000 are separated. The printer body 1000 and the scanner 2000 may be integrated. The printer body 1000 separated from or integrated with the scanner 2000 functions as a copying machine when a processing signal of the scanner 2000 is inputted to the laser scanner 111, and functions as a facsimile when a transmitting signal of the facsimile is inputted. The printer body 1000 separated from or integrated with the scanner 2000 functions as a printer when an output signal of a personal computer is inputted.

The printer body 1000 separated from or integrated with the scanner 2000 functions as a facsimile when a processing signal of the image processing portion 206 of the scanner 2000 is transmitted to a different facsimile. When an automatic original feeding apparatus 250 as indicated by the alternate long and two short dashes line is mounted in place of the pressing plate 203 on the scanner 2000, the original can be automatically read.

(Description of the Sheet Feeding Apparatus)

The sheet feeding apparatus 3000 of the image forming apparatus 1 illustrated in FIG. 1 will be described.

The sheet feeding apparatus 3000 has in its lower portion a sheet feeding portion 331 and in its upper portion a sheet feeding portion 332. The sheet feeding portions 331 and 332 have sheet storage portions 301 and 311 which can store a plurality of sheets S, respectively. The sheet storage portions 301 and 311 have trays 302 and 312 which are provided so as to support the stored sheets S, and a rear end regulating plate 303 which regulates the rear ends of the sheets S in a conveying direction (a direction indicated by the arrow A of FIG. 2), respectively. The trays 302 and 312 are provided so as to be raised or lowered. The rear end regulating plate 303 can be moved according to the size of the sheets S in a conveying direction and regulates the rear ends of the sheets in a conveying direction such that the front ends of the sheets in a conveying direction are arranged to the front end of the sheet storage portion 301 in a conveying direction. The sheet feeding portions 331 and 332 have the same configuration. The rear end regulating plate of the sheet feeding portion 332 is not illustrated.

Figure 2:
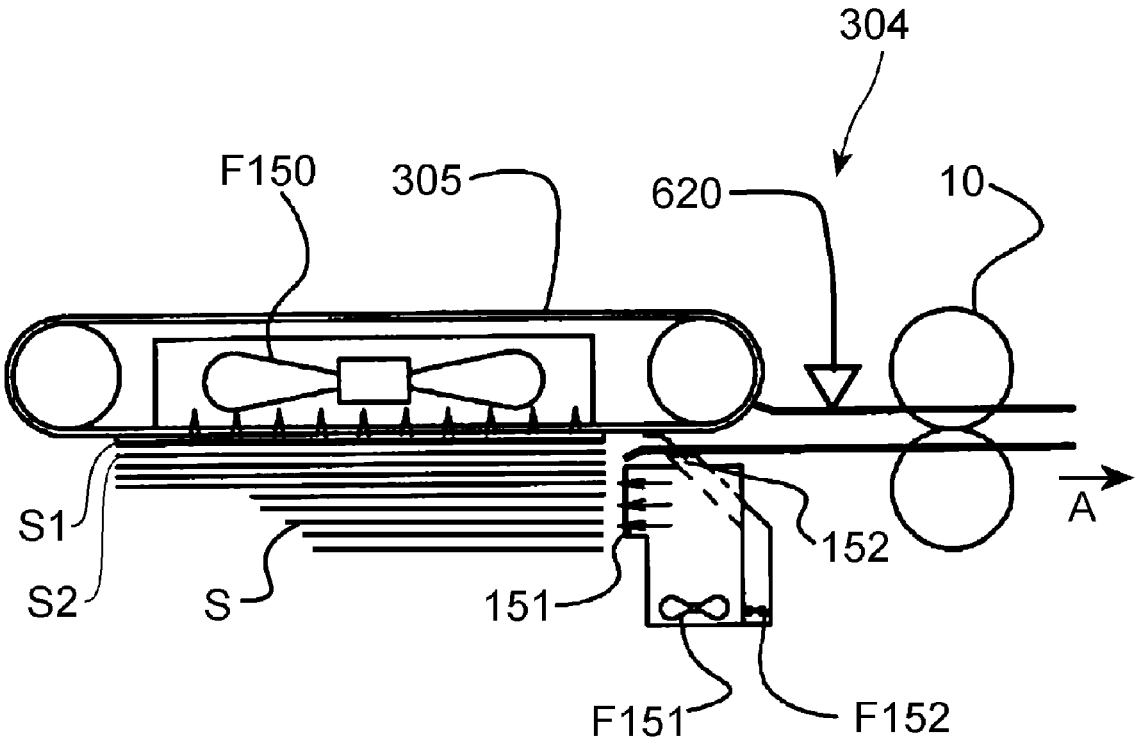
FIG. 2 is a cross-sectional view illustrating an example of a sheet separating and feeding portion of the sheet feeding apparatus of this embodiment.
Figure 3:
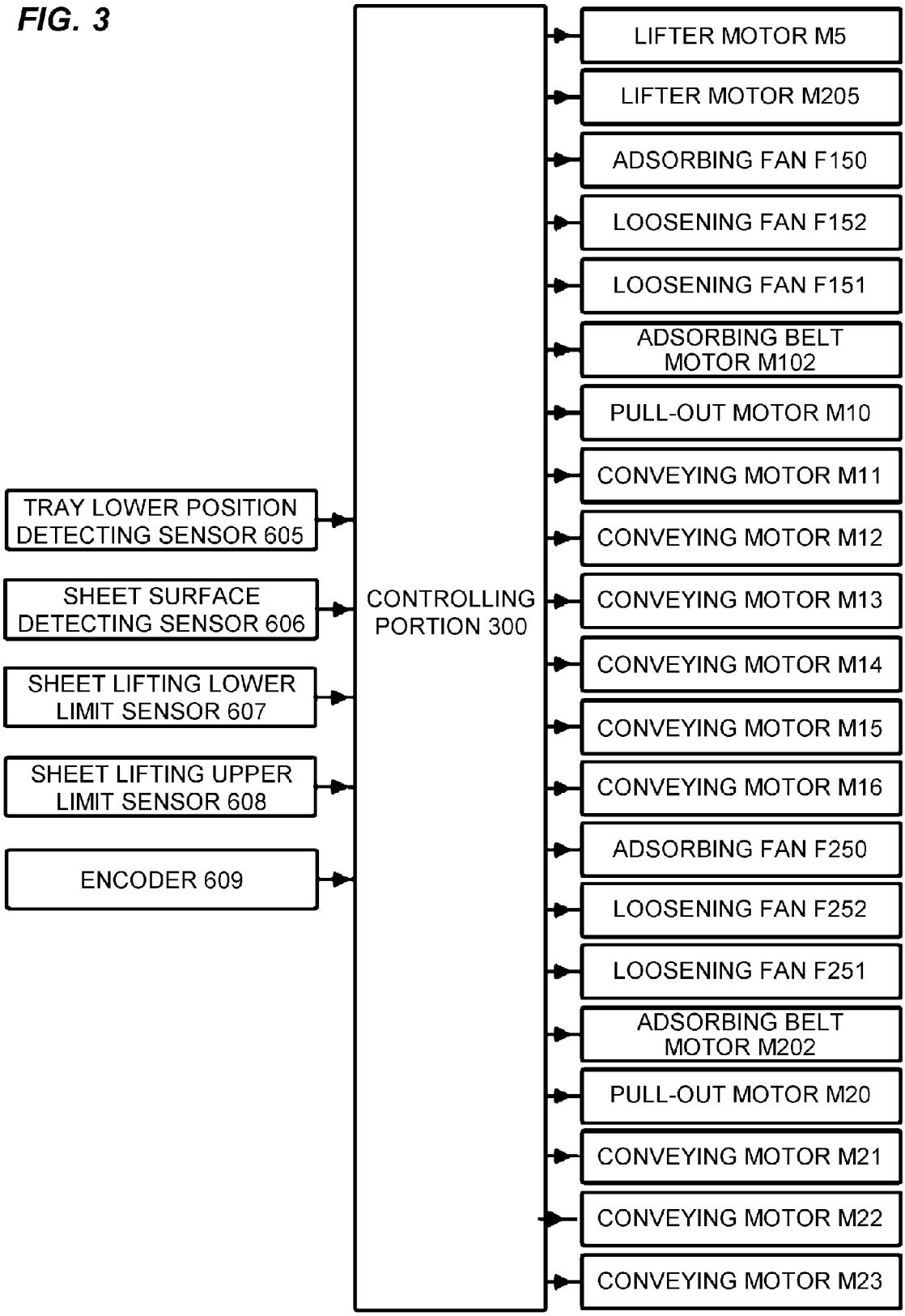
FIG. 3 is a control block diagram of the sheet feeding apparatus of this embodiment.

Here, using FIGS. 2 and 3, the sheet separating and feeding portion (air separating and feeding mechanism) of the sheet feeding apparatus will be described. FIG. 2 is an enlarged view of an essential part illustrating the sheet separating and feeding portion of the sheet feeding apparatus illustrated in FIG. 1. FIG. 3 is a control block diagram of the sheet feeding apparatus.

In a sheet separating and feeding portion 304, a loosening fan F151 is rotated as an operation before feeding and air is blown onto the sheets in the sheet storage portion 301 from a loosening nozzle 151 as an air blowing portion to start loosening the vicinity of the upper portion of the stacked sheets S. When a feeding start signal is transmitted from a controlling portion 300, a negative pressure (adsorbing force) is caused in an adsorbing and conveying belt 305 as a conveying portion by an adsorbing fan F150 to start adsorbing the sheets. After an elapse of a predetermined adsorption time from the start of adsorption, only an uppermost sheet S1 of the stacked sheets S is adsorbed onto the adsorbing and conveying belt 305. After an elapse of a predetermined time, the adsorbing and conveying belt 305 onto which the sheet S1 is adsorbed is started to be rotated by an adsorbing and conveying belt motor M102 such that the sheet S1 is conveyed in a direction of arrow A. The front end of the sheet which reaches a belt pulley portion is released from the adsorbing force by the adsorbing fan F150 and is then moved away from the adsorbing and conveying belt 305 so as to be passed to a pair of pull-out rollers 10. FIG. 2 illustrates a configuration having a loosening fan F152 which blows out air which separates the front end of the sheet from the adsorbing and conveying belt 305 from a separating nozzle 152. When the front end of the sheet S1 reaches the pair of pull-out rollers 10, the negative pressure by the adsorbing fan F150 is released so as to release the sheet from the adsorbing force onto the adsorbing and conveying belt 305. The sheet is then conveyed only by the conveying force of the pair of pull-out rollers 10. When the rear end of the sheet is pulled out from the adsorbing and conveying belt portion and the feeding start signal is transmitted from the controlling portion 300 again, the feeding operation is started to separate and feed the following sheet S2.

Here, before the feeding start signal is transmitted, the loosening fan F151 is operated as the operation before feeding. After the feeding start signal is transmitted, the loosening fan F151 may be controlled and operated.

Here, only the sheet separating and feeding portion 304 of the sheet storage portion 301 will be described. A sheet separating and feeding portion 314 is also provided in the sheet storage portion 311 so as to perform the same separating and feeding.

As illustrated in FIG. 3, the pair of pull-out rollers 10 and a pair of pull-out rollers 20 are connected to pull-out motors M10 and M20, respectively. Each pair of conveying rollers 11, 12, 13, 14, 15, 16, 21, 22, and 23 is connected to each of corresponding conveying motors M11, M12, M13, M14, M15, M16, M21, M22, and M23. The sheet feeding apparatus can independently drive each pair of rollers.

In FIG. 3, lifter motors M5 and M205 are lifter driving portions which raise or lower the trays 302 and 312 of the sheet feeding portions 331 and 332. The adsorbing and conveying belt motor M102 and an adsorbing and conveying belt motor M202 rotationally drive the adsorbing and conveying belt 305 and an adsorbing and conveying belt 315 in the sheet feeding portions 331 and 332. The adsorbing fan F150 and an adsorbing fan F250 adsorb the sheet onto the belts 305 and 315 of the sheet feeding portions 331 and 332. The sheet loosening fan F151 and a sheet loosening fan F251 are provided in the sheet feeding portions 331 and 332. The loosening fan F152 and a loosening fan F252 are provided in the sheet feeding portions 331 and 332. The operations of the operation portions are controlled by the controlling portion 300. The controlling portion 300 is provided in the sheet feeding apparatus 3000 and may be provided in the printer body 1000.

In FIG. 3, a tray lower position detecting sensor 605 is constituted as a tray detecting portion and the tray lower position detecting sensor 605 outputs a signal to detect the lower position of the tray. The lower position means a position where the tray 302 or 312 is the lowest in the raising or lowering range. A sheet surface detecting sensor 606 is constituted as a sheet surface detecting portion and the sheet surface detecting sensor 606 outputs a signal to detect the uppermost positions (sheet surfaces) of the sheets stacked on the trays 302 and 312. The tray lower position detecting sensor 605 is arranged below the sheet surface detecting sensor 606 in a sheet stacking direction and detects the lower positions as reference positions of the trays 302 and 312. A sheet lifting lower limit sensor 607 is constituted as a sheet lower limit detecting portion and a sheet lifting upper limit sensor 608 is constituted as a sheet upper limit detecting portion. The sheet lifting lower limit sensor 607 and the sheet lifting upper limit sensor 608 are constituted as sheet detecting portions which detect whether the sheet lifted by air from the loosening fan F151 is positioned within the predetermined range. The sheet lifting upper limit sensor 608, the sheet lifting lower limit sensor 607, and the sheet surface detecting sensor 606 are provided in the sheet separating and feeding portions. The tray lower position detecting sensor 605 is provided in the sheet storage portion. An encoder 609 is a tray movement detecting portion which detects the amount of driving of the lifter motor which raises or lowers the tray, that is, the amount of movement and the moving direction of the tray. Based on information (detected signals) from various sensors, the controlling portion 300 controls the operations of the operation portions, such as the operation of raising or lowering the tray.

Sheet information such as the size, type, and basis weight of the sheet stored in the sheet storage portions 301 and 311 can be set by the operation portion of the image forming apparatus.

(Description of a Control Block)

Figure 4:
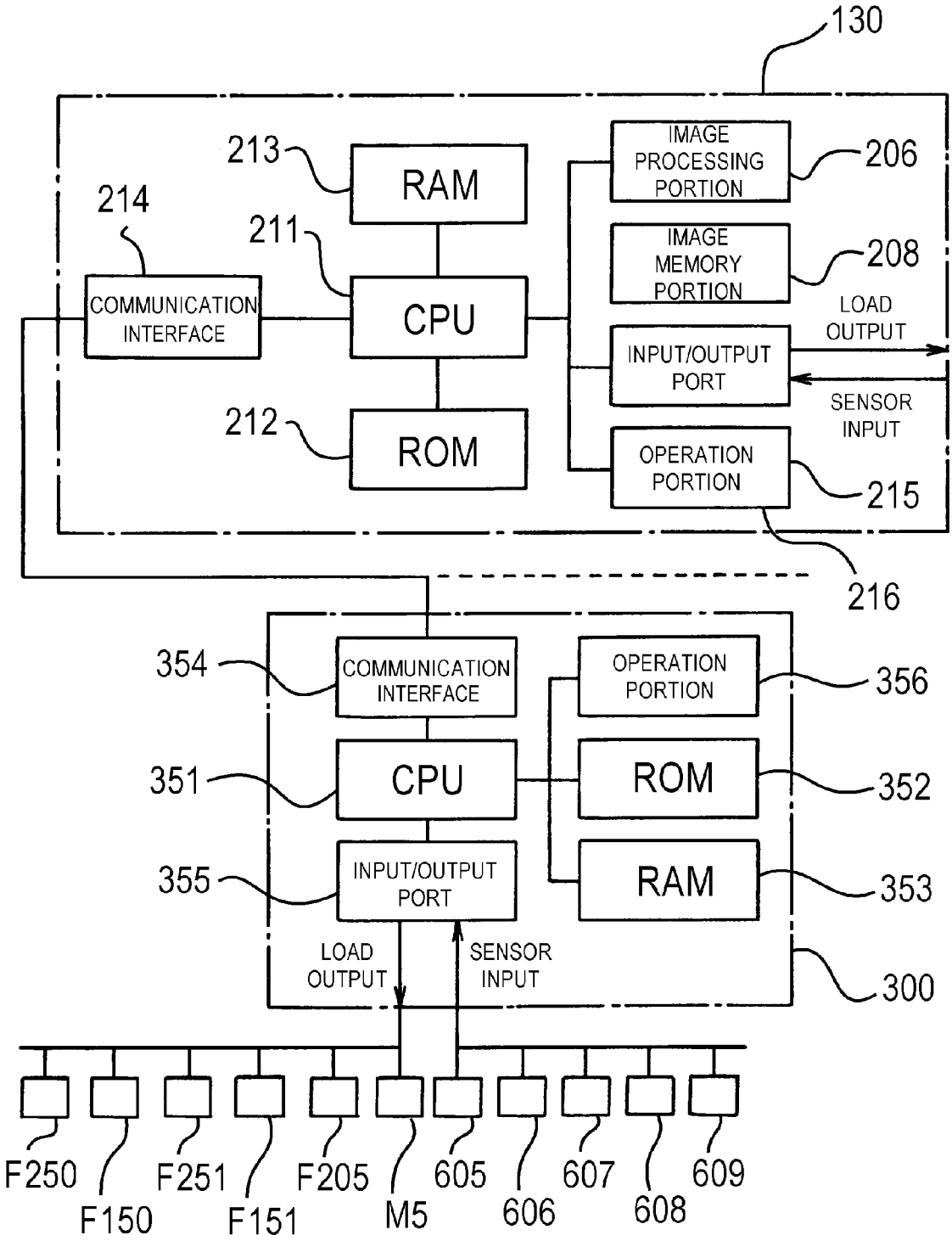
FIG. 4 is a block diagram illustrating the configuration of a controlling portion of a printer body and a controlling portion of the sheet feeding apparatus of this embodiment.

FIG. 4 is a block diagram illustrating the configuration of the controlling portion 130 in the printer body 1000 and the controlling portion 300 of the sheet feeding apparatus 3000 illustrated in FIG. 1.

The controlling portion 130 in the printer body 1000 has a CPU 211, a ROM 212, a RAM 213, a communication interface (I/F) 214, an input/output port 215, an operation portion 216, the image processing portion 206, and the image memory portion 208.

The CPU 211 performs basic control of the printer body 1000 and is connected to the ROM 212 into which a control program is written, the work RAM 213 which performs the processes, and the input/output port 215 via an address bus and a data bus. An area of part of the RAM 213 is a backup RAM which does not erase data when the power is turned off. The input/output port 215 is connected to various load devices, such as a motor or a clutch, controlled by the printer body 1000 and an inputting device, such as a sensor, which detects the position of the sheet.

The CPU 211 sequentially performs input/output control via the input/output port 215 according to the contents of the control program stored in the ROM 212 to execute the image forming process. The CPU 211 is connected to the operation portion 216 and controls a displaying portion and a key inputting portion of the operation portion 216. The user instructs the CPU 211 to change the image forming operation mode and display via the key inputting portion. The CPU 211 displays the operated state of the printer body 1000 and the operation mode set by key input on the displaying portion of the operation portion 216. The CPU 211 is connected to the image processing portion 206 which processes a signal converted to an electric signal by the image sensor portion (light receiving device) 205 and the image memory portion 208 which stacks processed images.

To realize the operation described using FIG. 1, the controlling portion 300 of the sheet feeding apparatus 3000 has a CPU 351, a ROM 352, a RAM 353, a communication interface (I/F) 354, an input/output port 355, and an operation portion 356. The CPU 351 inputs a detected result via the input/output port 355 from the later-described lifting upper limit sensor 608, lifting lower limit sensor 607, tray lower position detecting sensor 605, and sheet surface detecting sensor 606. Based on the detected result, the CPU 351 outputs a driving instruction to the later-described lifter motors M5 and M205, loosening fans F151 and F251, and adsorbing fans F150 and F250. The lifting upper limit sensor 608 is arranged above the lifting lower limit sensor 607. A distance-measuring sensor, not illustrated, which can measure a distance may be used in place of the lifting upper limit sensor and the lifting lower limit sensor.

(Description of the Operation Portion)

Figure 5:
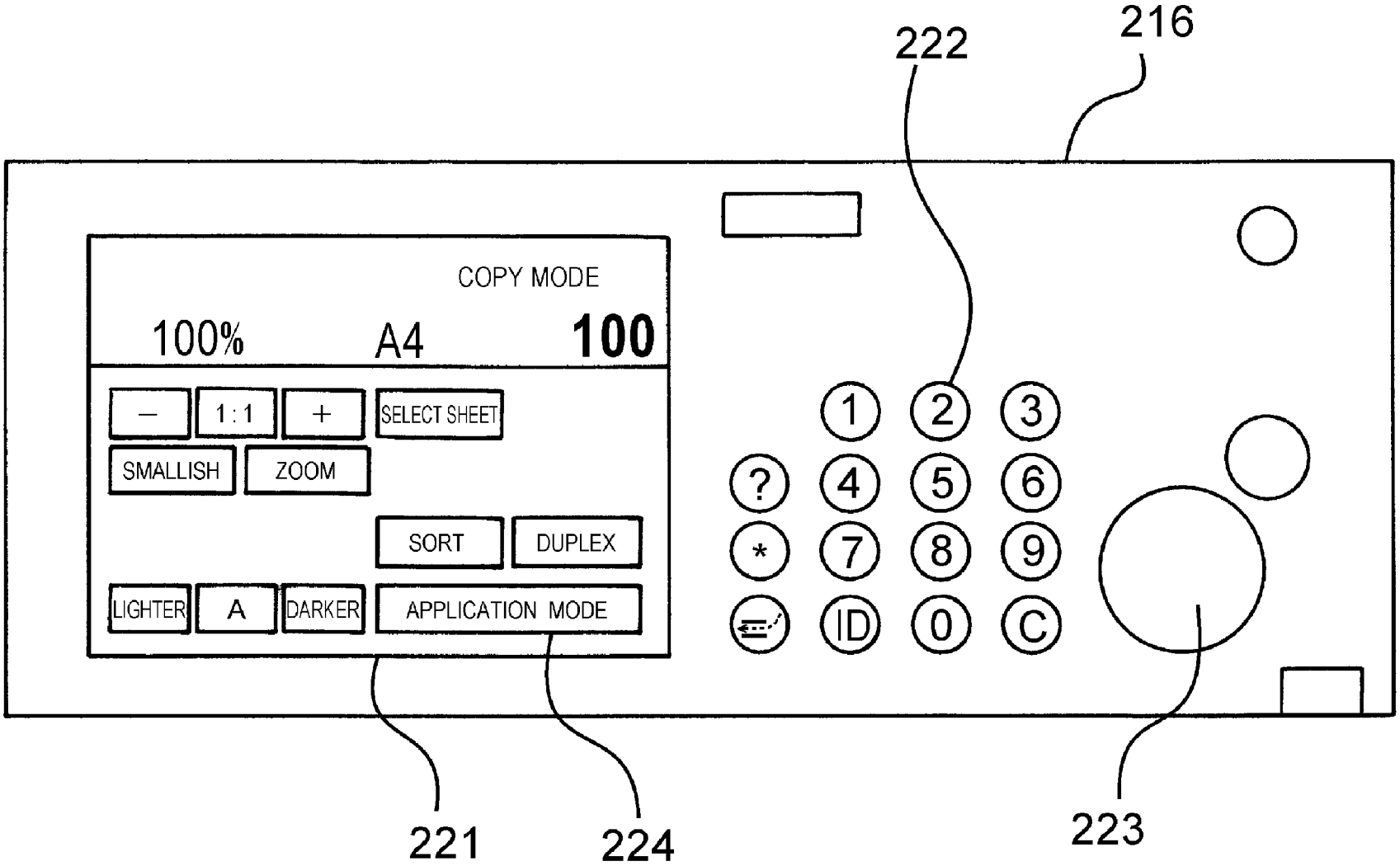
FIG. 5 is a schematic diagram illustrating an operation portion of the image forming apparatus of this embodiment.

FIG. 5 is a schematic diagram illustrating the configuration of the operation portion 216 of the image forming apparatus of this embodiment.

In FIG. 5, a displaying portion 221 displays various messages and operating procedures including the operated state of the apparatus and an operating instruction to the user. The surface of the displaying portion 221 has a touch panel and is touched to function as a selection key. A numeric keypad 222 inputs a number. A start key 223 is pressed to start the copying operation. An application mode selection key 224 can input sheet conditions such as the material, basis weight, and surface smoothness of the sheet surface.

Figure 6:
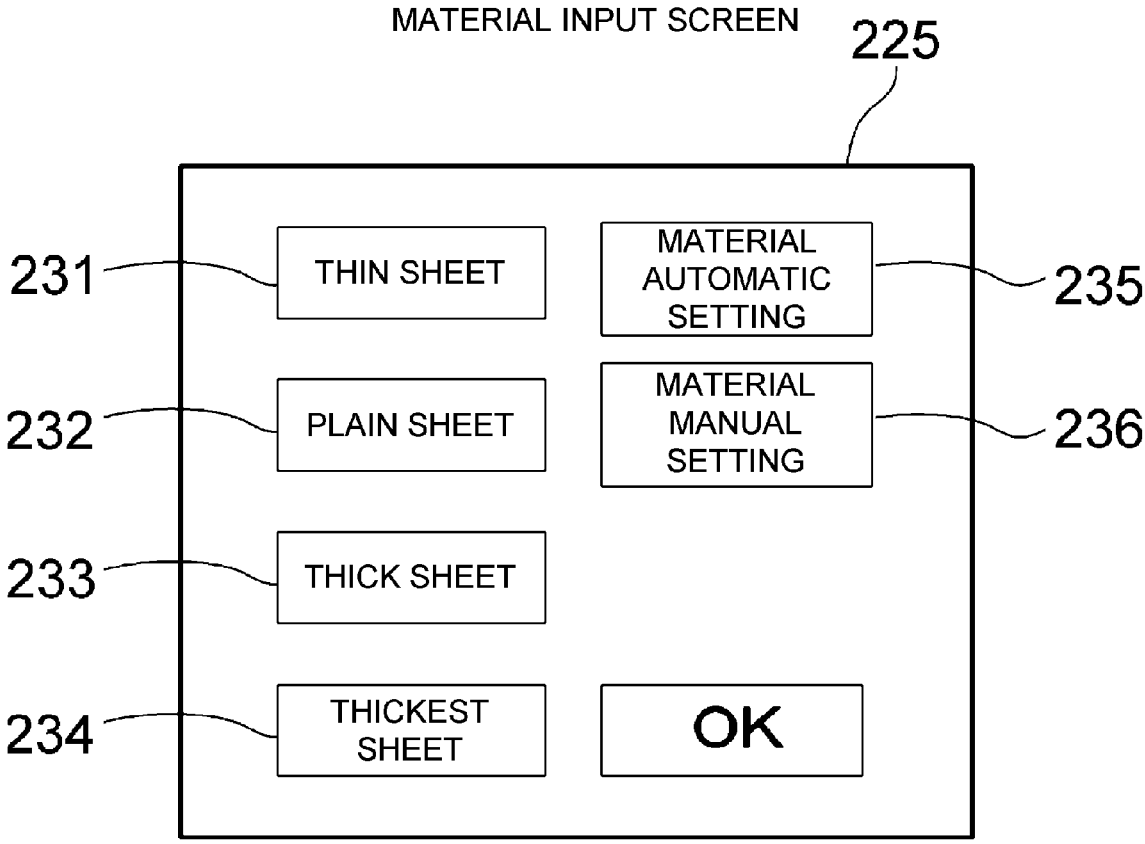
FIG. 6 is a diagram illustrating an operating screen to which sheet conditions are inputted.

The material of the sheet stored in the sheet feeding apparatus 3000 is selected from a displaying portion (operating screen) 225 as illustrated in FIG. 6. Here, as the specific material of the sheet, a thin sheet 231, a plain sheet 232, a thick sheet 233, and a thickest sheet 234 are illustrated. The material may be automatically set (the reference numeral 235 in the drawing). The sheet conditions such as the material, basis weight, and surface smoothness of the sheet surface may be finely set (the reference numeral 236 in the drawing).

The controlling portion 300 of the sheet feeding apparatus 3000 has a table which changes the rotating speeds of the loosening fans F151 and F251 so as to obtain optimal loosening air by setting the material (basis weight or surface properties) of the sheet set by the displaying portion 225 illustrated in FIG. 6. When the material of the sheet is not set, the plain sheet 232 is usually set. The material of the sheet other than the set items of the displaying portion illustrated in FIG. 6 may be finely set.

(Description of the Sheet Separating and Feeding Portion)

The configuration of the sheet separating and feeding portion (air separating and feeding mechanism) of the sheet feeding portion will be described.

Figure 7:
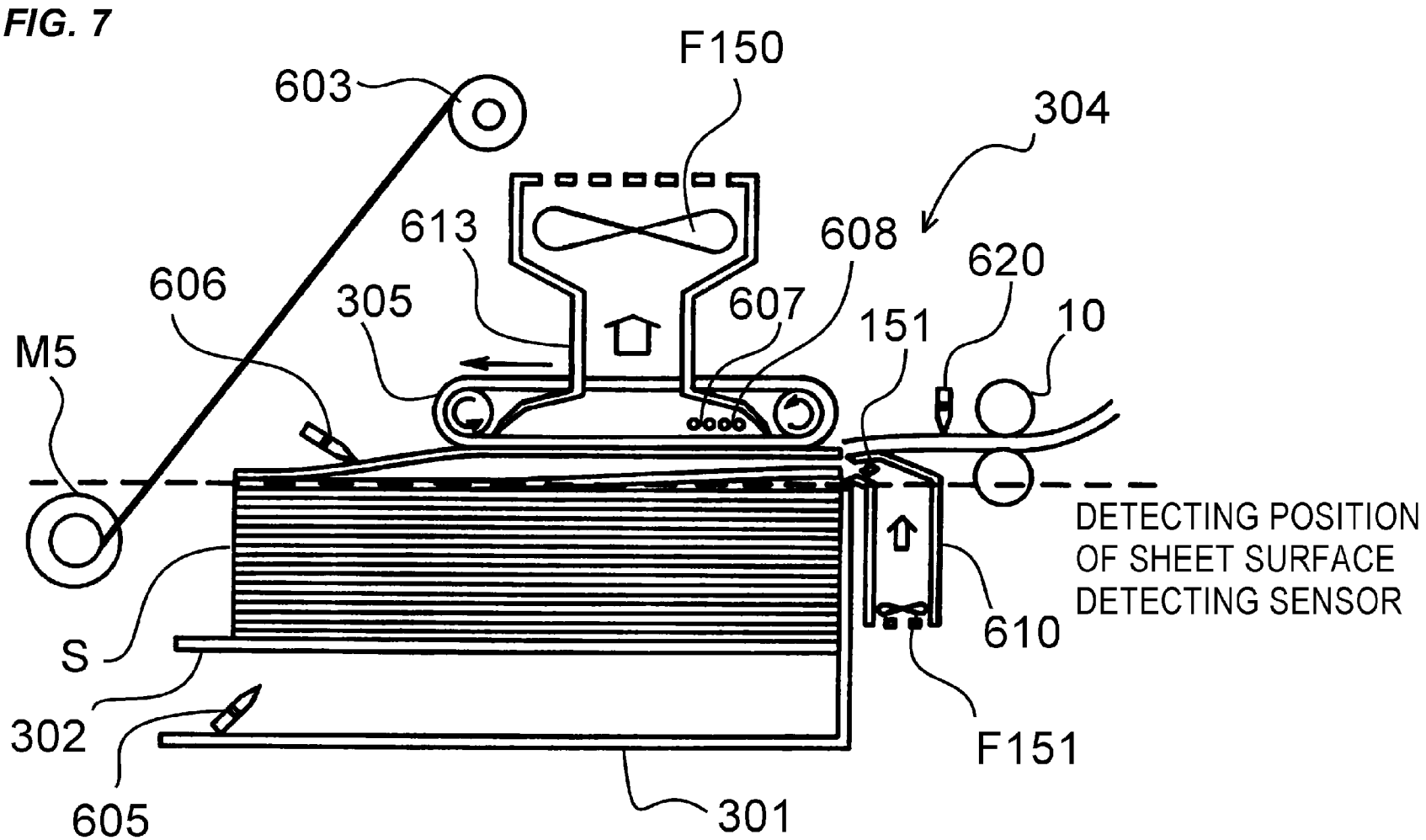
FIG. 7 is a cross-sectional view illustrating an example of the sheet separating and feeding portion of the sheet feeding apparatus of this embodiment.

FIG. 7 is a sectional configuration diagram of the sheet separating and feeding portion of the sheet feeding portion and the peripheral portion of the sheet storage portion. FIG. 2 illustrates the adsorbing fan F150 arranged in the adsorbing and conveying belt 305. As illustrated in FIG. 7, the adsorbing fan F150 may be arranged outside the adsorbing and conveying belt 305.

FIG. 7 illustrates the sheet separating and feeding portion 304 of the sheet feeding portion 331 of the sheet feeding apparatus 3000 illustrated in FIG. 1. The sheet feeding portion 332 of the sheet feeding apparatus 3000 has the same configuration.

In FIG. 7, the tray 302 which raises or lowers a sheet bundle as the stacked sheets S can be moved up and down by driving the lifter motor M5 via a pulley 603. The encoder 609 is attached to the lifter motor M5. The amount of driving of the lifter motor M5, that is, the amount of movement of the tray 302, can be identified by the encoder 609. The moving direction of the tray 302 can be identified by the rotating direction of the encoder 609 or a control signal of the motor.

The tray lower position detecting sensor 605 is arranged to detect the lower position of the tray 302. The tray lower limit detecting sensor (not illustrated) which detects the lower limit of the tray 302 may be provided below the tray lower position detecting sensor 605. When the tray 302 reaches the lower limit detecting sensor, some malfunction is assumed to occur. The tray driving portion (lifter motor of FIG. 3) is controlled so as to be stopped. Power supply to the tray driving portion may be interrupted.

The sheet surface detecting sensor 606 which detects the height of the sheets, the sheet lifting lower limit sensor 607, and the sheet lifting upper limit sensor 608 are arranged in the upper portion of the sheet separating and feeding portion 304. The sheet surface detecting sensor 606 detects the sheet by a flag sensor. The sheet lifting lower limit sensor 607 and the sheet lifting upper limit sensor 608 detect the sheet by an optical sensor. The sheet surface detecting sensor 606 is arranged below the sheet lifting lower limit sensor 607 and the sheet lifting upper limit sensor 608. When the sheets S stacked on the tray 302 are raised to a feeding start position, the sheet surface detecting sensor 606 can detect the upper surface (the uppermost sheet surface) of the sheet bundle S before the detection by the sheet lifting lower limit sensor 607 and the sheet lifting upper limit sensor 608. Here, the sheet lifting lower limit sensor 607 and the sheet lifting upper limit sensor 608 use the optical sensor. They may have the flag sensor.

The sheet lifting lower limit sensor 607 and the sheet lifting upper limit sensor 608 are sensors which detect the position of the sheet lifted by air from the later-described loosening fan F151. The sheet lifting lower limit sensor 607 is sensitivity adjusted so as to detect the lifted sheet positioned below the sheet lifting upper limit sensor 608. The sheet lifting lower limit sensor 607 and the sheet lifting upper limit sensor 608 are used to detect whether the lifted sheet is positioned within the predetermined range. The relation between the detected state of the sheet lifting lower limit sensor 607 and the sheet lifting upper limit sensor 608 and the sheet feeding state will be described later.

To loosen the sheets S stored in the sheet storage portion 301 before the feeding operation, the loosening fan F151 and a loosening fan duct 610 are provided. A wind pressure caused in a discharge direction by rotating the loosening fan F151 (the amount of air blown out) is given to near the uppermost sheet of the sheet bundle S by the loosening fan duct 610, thereby preventing the feeding of the plurality of sheets at a time during the sheet feeding operation (overlapped feeding).

The adsorbing and conveying belt 305, the adsorbing fan F150, and an adsorbing fan duct 613 are provided as a sheet feeding mechanism. A wind pressure caused in a suction direction by rotating the adsorbing fan F150 is given to the adsorbing and conveying belt 305 via the adsorbing fan duct 613 so as to adsorb the uppermost sheet of the sheet bundle S. The sheet adsorbed onto the adsorbing and conveying belt 305 is conveyed to a feeding sensor 620 and the pair of pull-out rollers 10 by rotating the adsorbing and conveying belt 305 in the illustrated direction.

FIG. 7 illustrates the state that the sheet is adsorbed by the adsorbing fan F150. When the sheet is adsorbed by the adsorbing fan F150, the sheet lifting lower limit sensor 607 and the sheet lifting upper limit sensor 608 cannot detect the lifting position of the sheet. The lifting position of the sheet is detected by the sheet lifting lower limit sensor 607 and the sheet lifting upper limit sensor 608 when the sheet is not adsorbed by the adsorbing fan F150.

Figure 8:
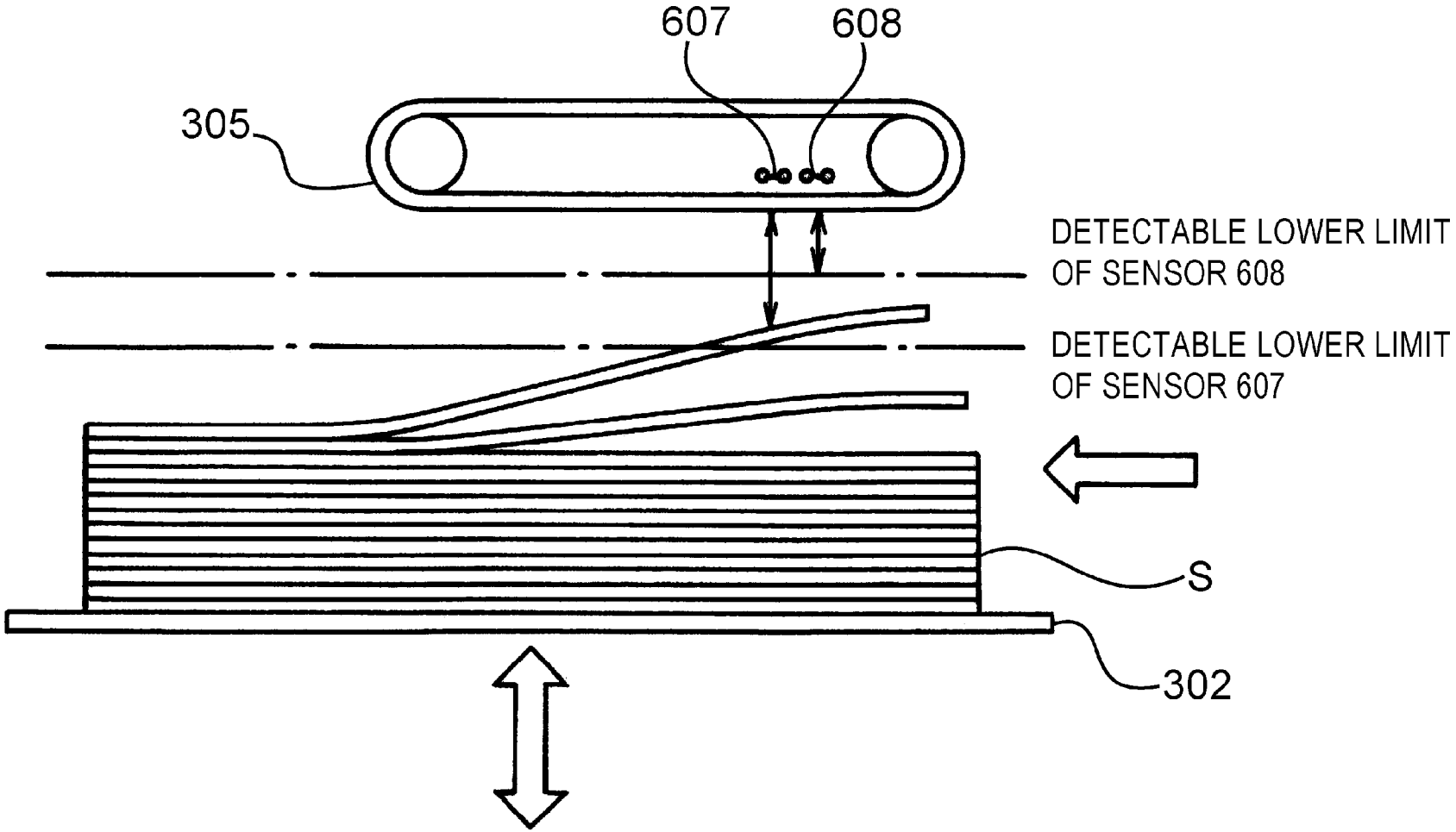
FIG. 8 is a diagram illustrating sheet detectable lower limits of a sheet lifting upper limit sensor and a sheet lifting lower limit sensor.

As illustrated in FIG. 8, while the loosening fan F151 is operated without operating the adsorbing fan F150, the raising or lowering of the tray 302 is controlled based on the sheet lifting lower limit sensor 607 and the sheet lifting upper limit sensor 608. The standby position of the sheet bundle S when both the adsorbing fan F150 and the loosening fan F151 are not operated indicates the state that the uppermost one of the stacked sheets is detected by the sheet surface detecting sensor 606 to stop the tray 302. When the tray 302 is raised due to sheet supply, the sheet surface detecting sensor 606 detects the upper surface of the sheets and then stops the tray 302 to position the sheet bundle S in the standby position.

In FIG. 7, the presence or absence of the sheets on the tray 302 is detected by the sheet surface detecting sensor 606. The detecting position (the dotted line position of FIG. 7) of the sheet surface detecting sensor 606 is arranged below the loosening nozzle 151 as the air blowing portion of the loosening fan duct 610 in a sheet stacking direction.

When the loosening fan F151 is controlled so as to change from the operated state to the non-operated state, the sheets loosened by the loosening fan F151 cannot be loosened. The sheet surface detecting sensor 606 is in the detected (ON) state in the stop position of the tray 302.

Figure 9A:
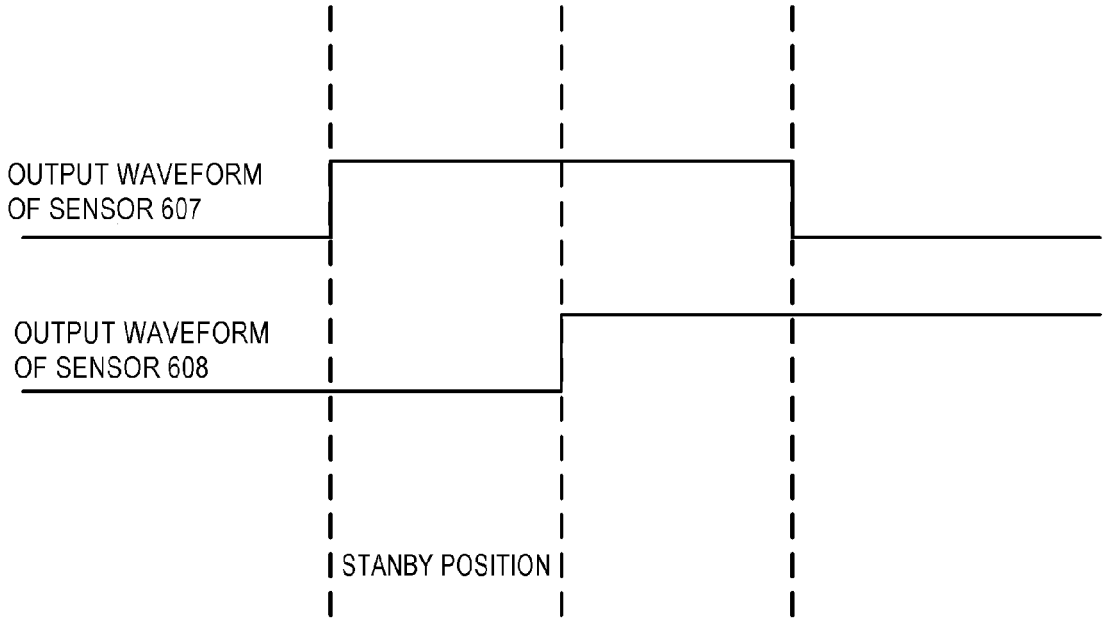
FIG. 9A is a diagram illustrating the logic of the sheet lifting upper limit sensor and the sheet lifting lower limit sensor in standby state.
Figure 9B:
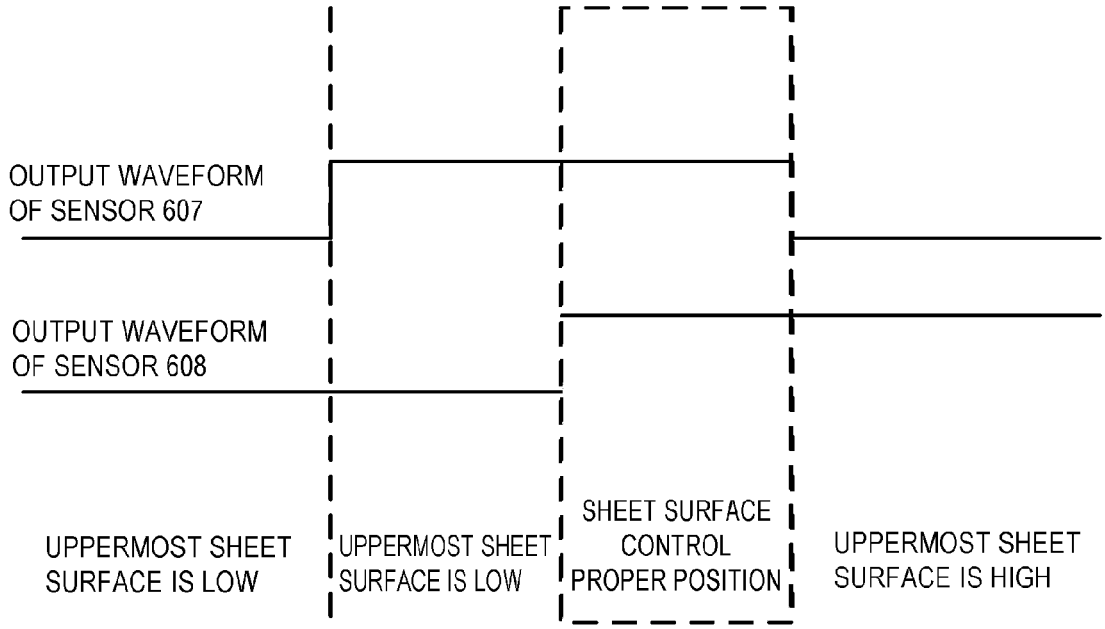
FIG. 9B is a diagram illustrating the logic of the sheet lifting upper limit sensor and the sheet lifting lower limit sensor after a loosening fan is operated.

In FIGS. 9A and 9B, the logic of the sheet lifting lower limit sensor 607 and the sheet lifting upper limit sensor 608 will be described. When both the adsorbing fan F150 and the loosening fan F151 are in the non-operated state and the sheet surface detecting sensor 606 is turned on, the position indicates the standby state of the sheet bundle S. When the loosening fan F151 is driven in this state, several upper sheets of the sheet bundle S are loosened to lift the uppermost sheet of the sheet bundle S. The raising or lowering of the tray 302 is controlled such that the lifted uppermost sheet enters between the sheet lifting lower limit sensor 607 and the sheet lifting upper limit sensor 608.

The sheet-detectable lower limits of the sheet lifting lower limit sensor 607 and the sheet lifting upper limit sensor 608 are as illustrated in FIG. 8. In FIGS. 7 and 8, the sheet lifting lower limit sensor 607 and the sheet lifting upper limit sensor 608 are arrayed in a sheet feeding direction. They are arrayed in a direction at a right angle with respect to a sheet feeding direction to enable more precise detection.

The sheet conditions such as the material, basis weight, surface smoothness of the surfaces of the sheets stacked on the tray 302 are inputted from the operating screen 225 illustrated in FIG. 6. The rotating speed of the loosening fan is set such that the wind pressure (air quantity) of the loosening fan F151 is optimal. When the loosening fan F151 is operated under the inputted sheet conditions, the uppermost sheet of the sheet bundle S is blown up and is moved to between the sheet lifting lower limit sensor 607 and the sheet lifting upper limit sensor 608 (a predetermined range) or moved above the sheet lifting upper limit sensor 608. When the loosening fan F151 is operated at the optimal rotating speed according to the material of the sheet, the sheet lifting lower limit sensor 607 and the sheet lifting upper limit sensor 608 are arranged in the positions which can detect the lifted sheet without raising or lowering the tray 302. When the sheet positioned in the predetermined range is moved outside the predetermined range due to reduction of the amount of the sheets stacked by feeding, the tray 302 is controlled so as to be moved until the sheet is returned to within the predetermined range (the amount of movement q), which will be described later.

(Detection of the Remaining Amount of the Sheets)

Figure 11:
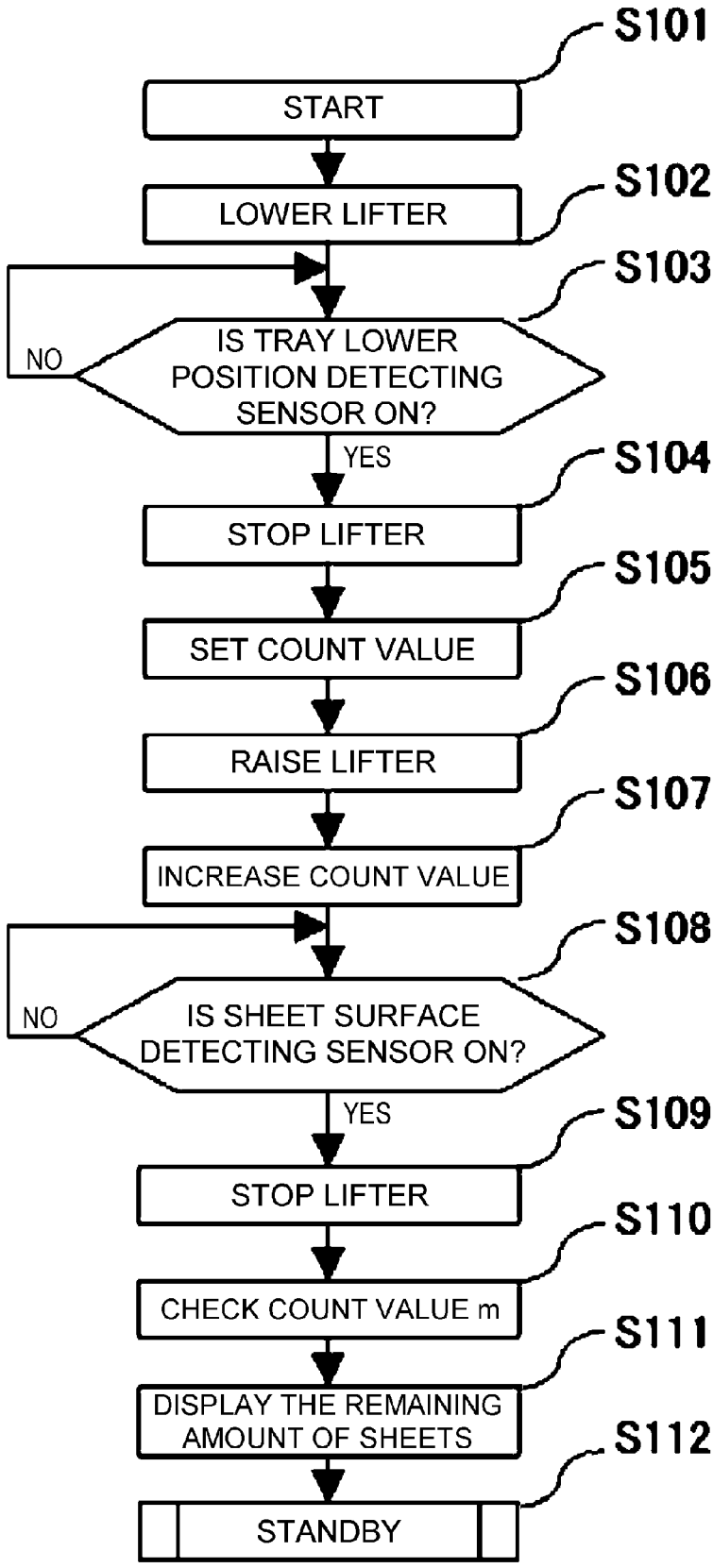
FIG. 11 is a flowchart describing an operation of the sheet feeding apparatus.
Figure 12:
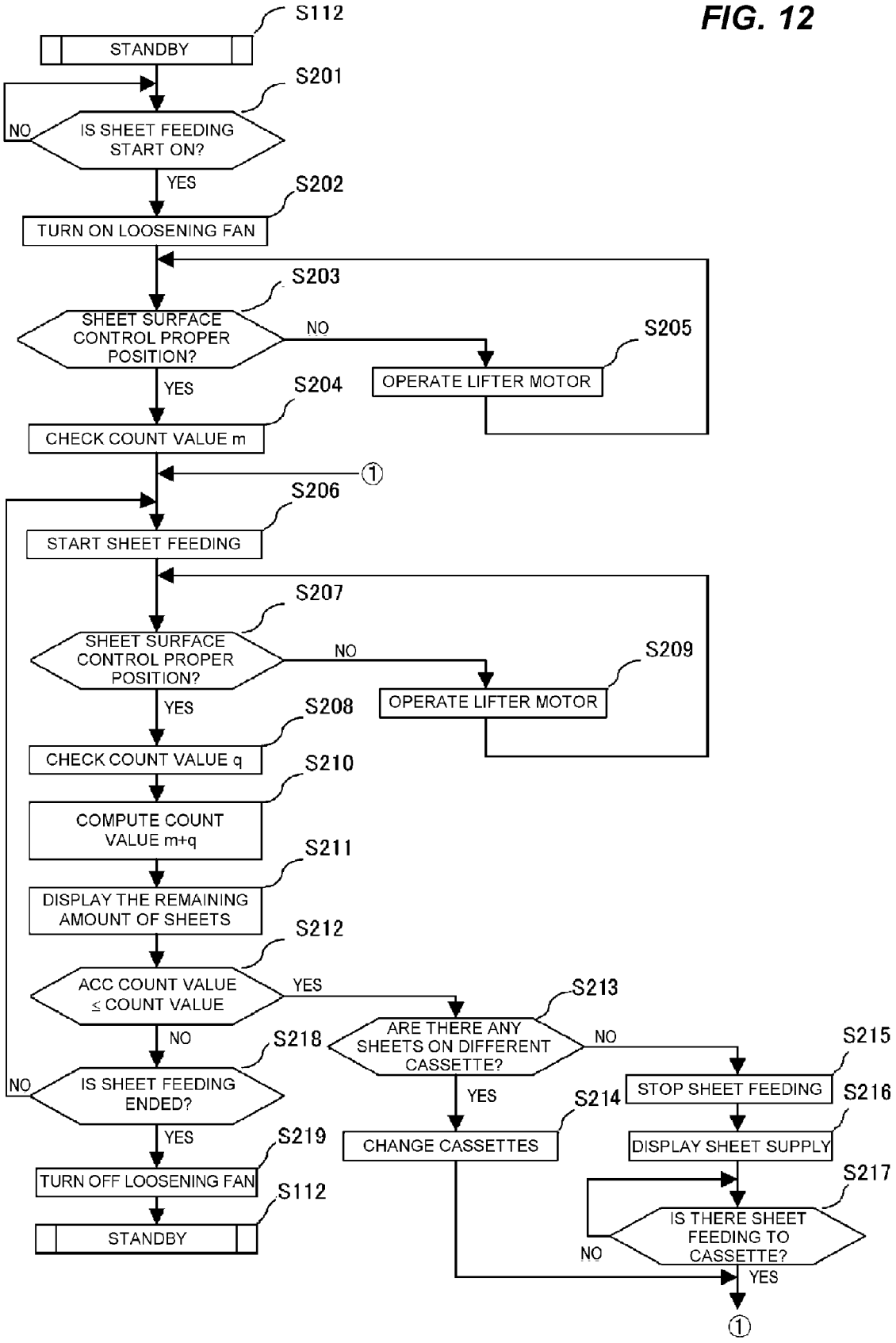
FIG. 12 is a flowchart describing an operation of the sheet feeding apparatus.

A method of detecting the remaining amount of the sheets on the tray will be described using FIGS. 10 to 12.

A disc of the encoder 609 is provided in the lifter motor M5 which drives the tray 302. Here, the driving system of the lifter motor M5 and the number of slits are determined such that the number of slits of the encoder 609 is 48 and the driving system has 0.307 mm/pls.

The relation between the count numbers of the encoder 609, the distances between the reference position and the tray 302, and the set values of a register in the RAM 353 of the controlling portion 300 are illustrated in FIG. 10.

The position of the tray lower position detecting sensor 605 which detects the tray 302 is the reference position of all. The distance is set to 0 mm, the count value is set to 0, and 8000 h is set to the register in the RAM 353 of the controlling portion 300 illustrated in FIG. 4. The register set value when the sheet surface stacked on the tray 302 is in the position of the sheet surface detecting sensor 606 is 8169 h. The register set value when the sheet surface stacked on the tray 302 is in the position of the lifting lower limit sensor 607 is 817 Dh. The register set value when the sheet surface stacked on the tray 302 is in the position of the lifting upper limit sensor 608 is 8187 h. The register set value when the sheet surface stacked on the tray 302 is in the position changing to a different sheet feeding portion is 815 Dh.

Using the flowchart of FIG. 11, an operation of the sheet feeding apparatus which is shifted to the standby state after power-on or sheet supply will be described.

Figure 13:
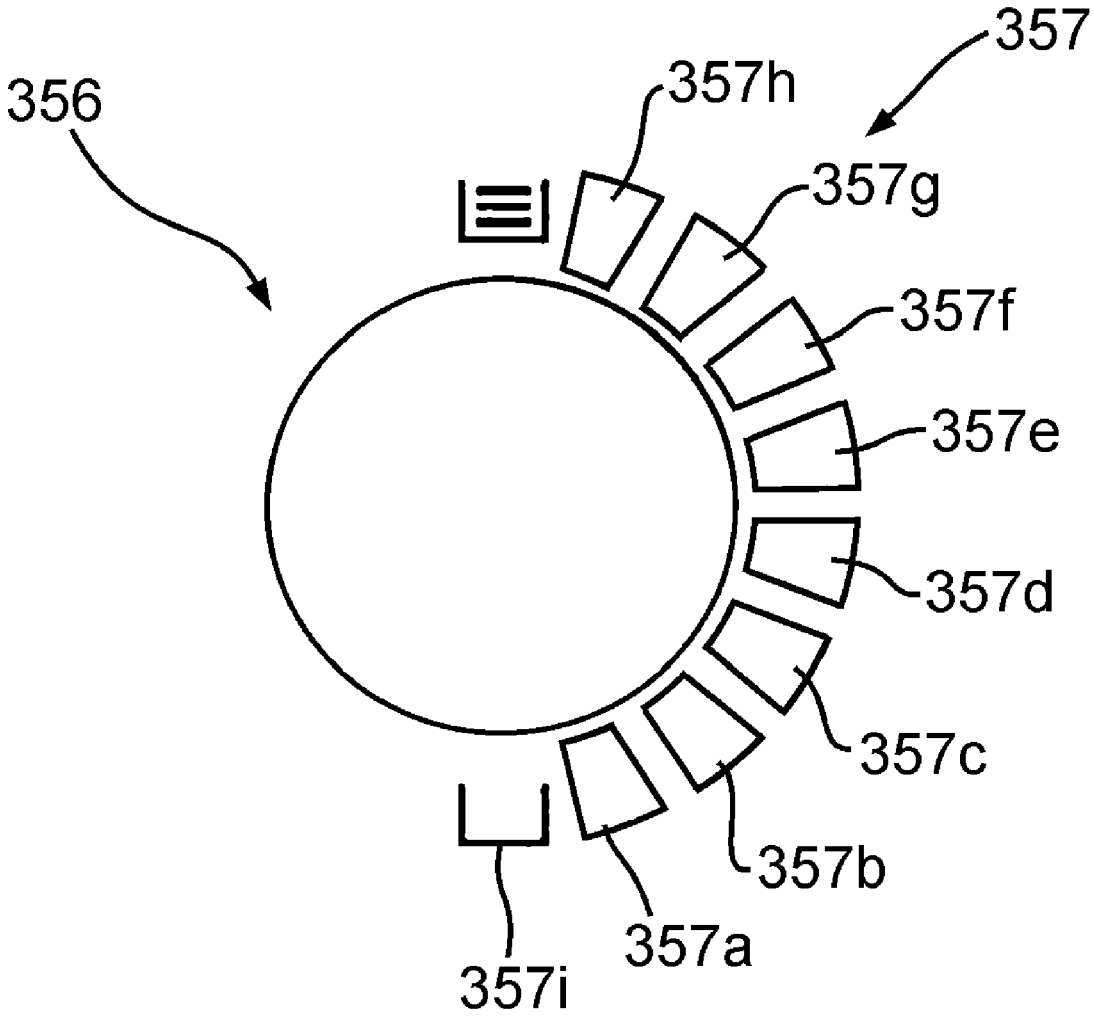
FIG. 13 is a diagram illustrating the display of the remaining amount of sheets in the operating portion.

When power-on or sheet supply is detected (S101), the lifter motor M5 is driven to drive the tray 302 in a lowering direction (S102). The lifter motor M5 is moved until the tray lower position detecting sensor 605 is turned on (S103). When the tray lower position detecting sensor 605 is turned on, the driving of the lifter motor M5 is stopped (S104). The count value is set to 0 and 8000 h is set to the register in the RAM 353 of the controlling portion 300 illustrated in FIG. 4 (S105). The lifter motor M5 is driven to drive the tray 302 in a raising direction (S106). Meanwhile, the count value is increased by the encoder 609 connected to the lifter motor M5 (S107). Here, in the method of increasing the counter value, a circuit which has a hardware configuration using an integrated circuit such as ASIC (Application Specific Integrated Circuit) to automatically add or subtract the counter value by inputting a pulse may be provided or the counter value may be computed in the CPU 351. The method is not limited to these. The raising of the tray 302 is continued until the sheet surface detecting sensor 606 is turned on (S108). When the sheet surface detecting sensor 606 is turned on, the driving of the lifter motor M5 is stopped (S109). The count value is checked and is m (S110). The count value m is the amount of movement of the tray 302 from the detection of the tray 302 by the tray lower position detecting sensor 605 to the detection of the uppermost position of the sheets on the tray 302 by the sheet surface detecting sensor 606. Specifically, when the tray 302 is raised by 30 mm from the position of the tray lower position detecting sensor 605, the count value m is 80. According to the count value m, the remaining amount of the sheets is displayed using a remaining amount displaying portion 357 of an operation portion 356 illustrated in FIG. 13 (S111). As illustrated in FIG. 13, the displaying of the remaining amount of the sheets is set in eight stages. LEDs 357*a* to 357*h* illuminate in order of increasing the remaining amount of the sheets. When the remaining amount of the sheets is small, only the LED 357*a* illuminates. When the remaining amount of the sheets is large (full), all the LEDs 357*a* to 357*h* illuminate. When the remaining amount of the sheets is zero, the LEDs 357*a* to 357*h* do not illuminate and a LED 357*i* is flashed. The sheet feeding apparatus is shifted to the standby state (S112).

Using the flowchart of FIG. 12, an operation of detecting the remaining amount of the sheets when the sheet feeding apparatus in the standby state starts feeding will be described.

When the feeding start signal is checked in the standby state (S112) (S201), the loosening fan F151 is turned on (S202). Here, as described in FIGS. 7, 8, and 9B, the sheets stacked on the tray 302 are loosened. As illustrated in FIGS. 9A and 9B, the lifter motor M5 is driven such that in sheet surface control, the sheet surface is in a sheet surface control proper position (S203). Specifically, when the sheet surface stacked on the tray 302 is below the lifting lower limit sensor 607, the lifter motor M5 is driven so as to raise the tray 302. When the sheet surface stacked on the tray 302 is above the lifting upper limit sensor 608, the lifter motor M5 is driven so as to lower the tray 302 (S205). The operation is repeated until the sheet surface stacked on the tray 302 is in the sheet surface control proper position. When the sheet surface stacked on the tray 302 is in the sheet surface control proper position, the count value is checked and is n (S204). The count value n is the amount of movement of the tray 302 from the detection of the uppermost position of the sheets on the tray 302 by the sheet surface detecting sensor 606 to the positioning of the sheet on the tray 302 in the proper position (predetermined range).

As described above, the feeding operation of the sheet feeding apparatus is started (S206). The feeding operation is continued and the sheet surface stacked on the tray 302 is outside the sheet surface control proper position (S207). The driving of the lifter motor M5 is controlled such that the sheet surface is in the sheet surface control proper position. Specifically, when the sheet surface stacked on the tray 302 is below the lifting lower limit sensor 607, the lifter motor M5 is driven so as to raise the tray 302. When the sheet surface stacked on the tray 302 is above the lifting upper limit sensor 608, the lifter motor M5 is driven so as to lower the tray 302 (S209). The operation is repeated until the sheet surface stacked on the tray 302 is in the sheet surface control proper position. When the sheet surface stacked on the tray 302 is in the sheet surface control proper position, the count value is checked and is q (S208). Here, the count value q is the amount of movement of the tray 302 until the sheet stacked on the tray 302 is returned into the proper position when the sheet stacked on the tray 302 is outside the proper position (predetermined range) due to reduction of the amount of the sheets stacked by feeding. The amount of movement q of the tray 302 increases the count value when the tray is moved in a raising direction. The amount of movement q of the tray 302 decreases the count value when the tray is moved in a lowering direction. Specifically, when the lifter motor M5 is raised by 1 mm such that the sheet surface is moved to the sheet surface control proper position in S207, the count value is 3.

To compute the remaining amount of the sheets, m+q is computed (S210). The controlling portion 300 calculates the amount of the sheets stacked on the tray 302 from the amount of movement m+q of the tray 302. Specifically, when the count values m=80 and q=3, m+q=83. As described in S111, the remaining amount of the sheets is displayed on the remaining amount displaying portion 357 of the operation portion 356 illustrated in FIG. 13 (S211). The computed result of m+q is compared with the value of an ACC (auto cassette change) position illustrated in FIG. 10 (S212). The value of the ACC position is a predetermined remaining amount of the sheets. When the computed result of m+q is the value of the ACC position or below, it is judged that the remaining amount of the sheets is large. Specifically, when m+q≦349, it is judged that the remaining amount of the sheets is large and the feeding operation is repeated when the feeding request is continued (S218). When the feeding operation is repeated and there is not the feeding request in S218, the loosening fan F151 is turned off (S219) to shift the sheet feeding apparatus to the standby state (S112). When the computed result of m+q is larger than the value of the ACC position in S212, it is judged that the remaining amount of sheets is small. Specifically, when m+q>349, it is judged that the remaining amount of the sheets is small so as to check whether there is a different tray (cassette) to which sheets under the same conditions (the same size or type) as those of the sheets on the present tray are set (S213). If the sheets under the same conditions are set to the different tray, the present tray is changed to the corresponding tray to continue feeding (S214). If, in S213, the sheets under the same conditions are not set to the different tray, the feeding operation is temporarily stopped (S215) and the display which promotes sheet supply to the operation portion 356 illustrated in FIG. 13 is performed (S216). When it is checked that sheets are supplied to the cassette (S217), the feeding operation is repeated again.

Here, the standby position of the sheet surface is set by the detection of the sheet surface detecting sensor 606. The same control may be performed based on the detection of the sheet lifting lower limit sensor 607.

As described above, according to this embodiment, the amount of the sheets stacked on the tray can be calculated from the amount of movement m of the tray in the state that the sheets are not loosened by air. The amount of the sheets stacked reduced by feeding from the tray can be calculated from the amount of movement q of the tray. The amount of the sheets stacked on the tray can be calculated from the amount of movement m+q of the tray. The remaining amount of the sheets in the sheet feeding apparatus can be stably detected regardless of the lifted state of the sheet.

In the above embodiment, the configuration of the sheet feeding apparatus having the two sheet feeding portions having the air separating and feeding mechanism is illustrated. The number of the sheet feeding portions having the air separating and feeding mechanism is not limited to this and may be appropriately set, as needed.

In the above embodiment, as the sheet feeding apparatus having the sheet loosening fan (air separating and feeding mechanism), there is illustrated the sheet feeding apparatus provided on the upstream side of the image forming apparatus body in a sheet conveying direction. The present invention is not limited to these and is effectively applicable to the sheet feeding apparatus provided integrally with the image forming apparatus body.

In the above embodiment, the copying machine is illustrated as the image forming apparatus. The present invention is not limited to this and may be other image forming apparatuses such as a printer, a facsimile, or a multiple function processing machine which combines these functions. The present invention is applied to the sheet feeding apparatus used for the image forming apparatuses to obtain the same effect.

In the above embodiment, the sheet feeding apparatus which can be detached from the image forming apparatus is illustrated. The present invention is not limited to this and may be the sheet feeding apparatus provided integrally with the image forming apparatus. The present invention is applied to the sheet feeding apparatus to obtain the same effect.

In the above embodiment, the sheet feeding apparatus which feeds a sheet to be recoded, such as a recording sheet, is illustrated. The present invention is not limited to this and is applied to the sheet feeding apparatus which feeds a sheet to be read, such as an original, to obtain the same effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-220834, filed Aug. 28, 2007, which is hereby incorporated by reference herein in its entirety.

What is claimed is:

1. A sheet feeding apparatus comprising:

a tray which stacks a plurality of sheets and is raiseable or lowerable;

an air blowing portion which blows air toward the ends of the sheets stacked on the tray to loosen the sheets;

a conveying portion which conveys an uppermost sheet positioned within a predetermined range among the sheets loosened by the air from the air blowing portion;

a sheet detecting portion which detects whether the uppermost sheet loosened by the air from the air blowing portion is positioned within the predetermined range;

a sheet surface detecting portion which detects an uppermost position of the sheets stacked on the tray;

a tray detecting portion which detects a reference position of the tray below the sheet surface detecting portion in a sheet stacking direction;

a tray movement detecting portion which detects the amount of movement of the tray;

a controlling portion which moves the tray from the reference position to a position at which the uppermost position of the sheets stacked on the tray is detected by the sheet surface detecting position, and moves the tray from which the uppermost sheet loosened by the air from the air blowing portion is positioned within the predetermined range based on a detection by the sheet detecting portion;

a remaining amount calculation portion which calculates the amount of the sheets stacked on the tray from (m+q), where (m) represents the amount of movement of the tray from the reference position of the tray detected by the tray detecting portion to the uppermost position of the sheets on the tray detected by the sheet surface detecting portion, and (q) represents the amount of movement of the tray from which the uppermost sheet loosened by the air from the air blowing portion is moved from outside the predetermined range to within the predetermined range detected by the tray movement detection portion; and a remaining amount displaying portion which displays the amount of the sheets stacked on the tray calculated by the remaining amount calculation portion.

2. The sheet feeding apparatus according to claim 1, wherein the amount of movement (q) of the tray increases a count value when the tray is moved in a raising direction and decreases the count value when the tray is moved in a lowering direction.

3. The sheet feeding apparatus according to claim 1, further comprising:

a plurality of the trays, wherein when the calculated amount of the sheets stacked on the tray is smaller than a predetermined remaining amount of the sheets, a present tray is changed to a different tray to which sheets under the same conditions as those of the sheets on the present tray are set.

4. The sheet feeding apparatus according to claim 1, wherein when the calculated amount of the sheets stacked on the tray is smaller than a predetermined remaining amount of the sheets, an operation of feeding the sheets from the tray is stopped.

5. An image forming apparatus comprising:

a sheet feeding apparatus which feeds each of sheets; and an image forming portion which forms an image on the sheet fed from the sheet feeding apparatus, wherein the sheet feeding apparatus comprises:

a tray which stacks a plurality of sheets and is raisable or lowerable;

an air blowing portion which blows air toward the ends of the sheets stacked on the tray to loosen the sheets;

a conveying portion which conveys an uppermost sheet within a predetermined range among the sheets loosened by the air from the air blowing portion;

a sheet detecting portion which detects whether the uppermost sheet loosened by the air from the air blowing portion is positioned within the predetermined range;

a sheet surface detecting portion which detects an uppermost position of the sheets stacked on the tray;

a tray detecting portion which detects a reference position of the tray below the sheet surface detecting portion in a sheet stacking direction;

a tray movement detecting portion which detects the amount of movement of the tray;

a controlling portion which moves the tray from the reference position to a position at which the uppermost position of the sheets stacked on the tray is detected by the sheet surface detecting position, and moves the tray from which the uppermost sheet loosened by the air from the air blowing portion is positioned within the predetermined range based on a detection by the sheet detecting portion;

a remaining amount calculation portion which calculates the amount of the sheets stacked on the tray from (m+q), where (m) represents the amount of movement of the tray from the reference position of the tray detected by the tray detecting portion to the uppermost position of the sheets on the tray detected by the sheet surface detecting portion, and (q) represents the amount of movement of the tray from which the uppermost sheet loosened by the air from the air blowing portion is moved from outside the predetermined range to within the predetermined range detected by the tray movement detection portion; and a remaining amount displaying portion which displays the amount of the sheets stacked on the tray calculated by the remaining amount calculation portion.

6. The image forming apparatus according to claim 5, wherein the amount of movement (q) of the tray increases a count value when the tray is moved in a raising direction and decreases the count value when the tray is moved in a lowering direction.

7. The image forming apparatus according to claim 5, further comprising:

a plurality of the trays, wherein when the calculated amount of the sheets stacked on the tray is smaller than a predetermined remaining amount of the sheets, a present tray is changed to a different tray to which sheets under the same conditions as those of the sheets on the present tray are set.

8. The image forming apparatus according to claim 5, wherein when the calculated amount of the sheets stacked on the tray is smaller than a predetermined remaining amount of the sheets, an operation of feeding the sheets from the tray is stopped.

* * * * *